US010744662B2

(12) United States Patent
Bozikis et al.

(10) Patent No.: US 10,744,662 B2
(45) Date of Patent: Aug. 18, 2020

(54) SHAVING HEAD

(71) Applicant: BIC-VIOLEX S.A., Anixi (GR)

(72) Inventors: Ioannis Bozikis, Athens (GR); Stavros Drakopoulos, Rafina (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 15/769,402

(22) PCT Filed: Dec. 16, 2016

(86) PCT No.: PCT/IB2016/057724

§ 371 (c)(1),
(2) Date: Apr. 19, 2018

(87) PCT Pub. No.: WO2017/103882

PCT Pub. Date: Jun. 22, 2017

(65) Prior Publication Data

US 2018/0304484 A1 Oct. 25, 2018

Related U.S. Application Data

(60) Provisional application No. 62/268,638, filed on Dec. 17, 2015.

(51) Int. Cl.
*B26B 21/40* (2006.01)
*B26B 21/44* (2006.01)
(Continued)

(52) U.S. Cl.
CPC ..... *B26B 21/4012* (2013.01); *B26B 21/4018* (2013.01); *B26B 21/4025* (2013.01); *B26B 21/4068* (2013.01); *B26B 21/443* (2013.01); *B26B 21/565* (2013.01); *B26B 21/06* (2013.01); *B26B 21/225* (2013.01)

(58) Field of Classification Search
CPC ..... B26B 21/4012; B26B 21/565; Y10T 24/44769
See application file for complete search history.

(56) References Cited

U.S. PATENT DOCUMENTS 3,590,483 A * 7/1971 Szczepanski ..... B26B 5/00 30/31
3,852,883 A * 12/1974 Ferraro ..... B26B 21/22 30/346.58

(Continued)

FOREIGN PATENT DOCUMENTS

CA 2931697 6/2015
CA 2937358 9/2015

(Continued)

OTHER PUBLICATIONS

International Search Report for PCT/IB2016/057724, dated Mar. 6, 2017.

(Continued)

*Primary Examiner* — Sean M Michalski
(74) *Attorney, Agent, or Firm* — Polsinelli PC

(57) ABSTRACT

A shaving head includes a housing, at least one retainer extending from the housing, and at least one component retained within the housing by the retainer. The retainer includes a body. The body of the retainer is bent such that at least a portion of the components is covered by a portion of the retainer.

11 Claims, 4 Drawing Sheets

(51) Int. Cl.

| | |
|---|---|
| ***B26B 21/56*** | (2006.01) |
| *B26B 21/06* | (2006.01) |
| *B26B 21/22* | (2006.01) |

(56) References Cited

U.S. PATENT DOCUMENTS

| | | | | | |
|---|---|---|---|---|---|
| 3,994,050 | A * | 11/1976 | Bub | A47G 1/0638 | 24/562 |
| 4,389,773 | A * | 6/1983 | Nissen | B26B 21/22 | 30/32 |
| 4,403,412 | A * | 9/1983 | Trotta | B26B 21/227 | 30/47 |
| 4,605,978 | A * | 8/1986 | Zeavin | F16B 2/245 | 24/457 |
| 4,794,692 | A * | 1/1989 | Wang | B25F 1/003 | 30/123 |
| 4,852,254 | A * | 8/1989 | Duncan | B26B 21/06 | 30/50 |
| 4,866,844 | A * | 9/1989 | Burout, III | B26B 21/22 | 30/50 |
| 5,377,409 | A * | 1/1995 | Chen | B26B 21/4012 | 30/41 |
| 5,501,014 | A * | 3/1996 | Hegemann | B26B 21/222 | 30/346.5 |
| 6,009,624 | A * | 1/2000 | Apprille, Jr. | B26B 21/227 | 30/50 |
| 6,161,287 | A * | 12/2000 | Swanson | B26B 21/225 | 30/50 |
| 6,212,777 | B1 * | 4/2001 | Gilder | B26B 21/4031 | 30/50 |
| 8,307,553 | B2 | 11/2012 | Follo et al. | | |
| 9,539,734 | B1 * | 1/2017 | Bozikis | B26B 21/227 | |
| 9,757,870 | B2 * | 9/2017 | Giannopoulos | B26B 21/222 | |
| D832,516 | S * | 10/2018 | Bozikis | B26B 21/4018 | D28/47 |
| 2002/0046465 | A1 * | 4/2002 | McCool | B26B 21/222 | 30/50 |
| 2003/0006347 | A1 * | 1/2003 | Ogden | F16L 3/006 | 248/58 |
| 2004/0119657 | A1 * | 6/2004 | Mayer | H01Q 1/088 | 343/906 |
| 2004/0258385 | A1 * | 12/2004 | Kadrnoska | G02B 6/4459 | 385/136 |
| 2005/0091855 | A1 * | 5/2005 | Hannan | B26B 21/16 | 30/346.5 |
| 2005/0188539 | A1 * | 9/2005 | Prudden, Jr. | B26B 21/4012 | 30/41 |
| 2008/0115449 | A1 * | 5/2008 | Kodi | E04C 5/167 | 52/719 |
| 2008/0196251 | A1 * | 8/2008 | Royle | B26B 21/227 | 30/50 |
| 2009/0056142 | A1 * | 3/2009 | Royle | B26B 21/38 | 30/43.7 |
| 2009/0188112 | A1 * | 7/2009 | Prochaska | B26B 21/222 | 30/34.05 |
| 2009/0193659 | A1 * | 8/2009 | Park | B26B 21/225 | 30/50 |
| 2010/0077619 | A1 * | 4/2010 | Follo | B26B 21/225 | 30/50 |
| 2011/0119922 | A1 * | 5/2011 | Ntavos | B26B 21/222 | 30/32 |
| 2011/0308089 | A1 | 12/2011 | Bridges | | |
| 2012/0324737 | A1 * | 12/2012 | Howell | B26B 21/4018 | 30/50 |
| 2013/0097872 | A1 * | 4/2013 | Blatter | B26B 21/4018 | 30/50 |
| 2013/0205595 | A1 * | 8/2013 | Bykowski | B26B 21/4012 | 30/64 |
| 2014/0000114 | A1 | 1/2014 | Wester et al. | | |
| 2014/0150217 | A1 * | 6/2014 | Valiulis | G09F 3/16 | 24/489 |
| 2014/0163488 | A1 * | 6/2014 | Vaillancourt | F16B 2/22 | 604/319 |
| 2014/0230252 | A1 * | 8/2014 | Davos | B26B 21/4031 | 30/50 |
| 2015/0021446 | A1 * | 1/2015 | Korcz | F16L 3/1215 | 248/58 |
| 2015/0082638 | A1 * | 3/2015 | Georgakis | B26B 21/222 | 30/77 |
| 2015/0090085 | A1 * | 4/2015 | Griffin | B26B 21/4018 | 83/13 |
| 2016/0297086 | A1 * | 10/2016 | Efthimiadis | B26B 21/4012 | |
| 2018/0311847 | A1 * | 11/2018 | Ntavos | B26B 21/4012 | |
| 2018/0354146 | A1 * | 12/2018 | Brellis | B26B 21/222 | |
| 2018/0361604 | A1 * | 12/2018 | Bozikis | B26B 21/4012 | |
| 2019/0016001 | A1 * | 1/2019 | Zucker | B26B 21/4012 | |
| 2019/0160698 | A1 * | 5/2019 | Efthimiadis | B26B 21/227 | |
| 2019/0168402 | A1 * | 6/2019 | Efthimiadis | B26B 21/565 | |

FOREIGN PATENT DOCUMENTS

| | | | |
|---|---|---|---|
| CN | 1298335 | C | 6/2001 |
| CN | 103608153 | A | 2/2014 |
| CN | 102947062 | A | 1/2016 |
| CN | 104428108 | A | 7/2017 |
| WO | 2005/090023 | A1 | 9/2005 |
| WO | 2012/158142 | A1 | 11/2012 |
| WO | 2012/12158142 | A1 | 11/2012 |
| WO | 2012158142 | A1 | 11/2012 |
| WO | 2015/082002 | A1 | 6/2015 |
| WO | 2015/090385 | A1 | 6/2015 |
| WO | 2015082002 | A1 | 6/2015 |
| WO | 2015090385 | A1 | 6/2015 |

OTHER PUBLICATIONS

Chinese Search Report for Chinese Patent Application No. CN2016800633995, dated Aug. 16, 2019.

Office Action for Canadian Patent Application No. 3,001,664, dated Feb. 25, 2020.

* cited by examiner

SHAVING HEAD

CROSS-REFERENCE TO RELATED APPLICATION

This application is a National Stage of International Application No. PCT/IB2016/057724, filed Dec. 16, 2016, which claims priority to U.S. Provisional Patent Application No. 62/268,638, filed in the U.S. Patent and Trademark Office on Dec. 17, 2015, all of which is incorporated herein by reference in its entirety for all purposes.

BACKGROUND

1. Field

The following description relates to shaving razors. A shaving razor may include a head with one or more blades and a retainer configured to retain components of the shaving head. For example, a shaving razor may include a head with one or more blades which are secured in the head by a sheet retainer. The sheet retainer may be bent to cover at least one portion of the blades.

2. Description of Related Art

Shaving razors include shaving heads which contain components such as shaving blades, lubrication strips, guard bars, covers, and trimming blades. The components in conventional shaving heads would be individually and separately retained within the shaving head. As such, the components would each have separate retaining means; for example traditional clips may be utilized for each component. However, bending traditional clip legs at multiple locations of the cartridge provides for difficulties in manufacturing while also providing multiple locations for retaining the components and managing the tolerances that are applied Further, several disadvantages are typically encountered in the manufacture of such conventional mechanisms. During the manufacturing process, clips may encounter buckling as a result of force that is applied during installation of the clips. As a result of bending force exerted on the clips, the clips have a tendency to buckle upwards. Consequently, blade exposures may be unstable throughout the razor cartridge and may vary significantly from intended blade exposure values. Also, during the manufacturing process, clips may fail to be properly installed in a razor housing, which requires additional attention and labor to ensure that all of the clips are properly installed in the housing. Thus, the manufacture of such conventional mechanisms is inefficient, which results in production delays and increased production costs.

SUMMARY

The present inventive concept provides a shaving razor that overcomes the aforementioned disadvantages of conventional shaving razors. The shaving razor of the present inventive concept generally includes a shaving head with a housing and one or more components. The components may be at least one blade, a guard bar, a cap, at least one lubrication strip, or a combination thereof. The components are partially covered and secured in the housing by at least one retainer. The at least one retainer extends from a top side of the housing and is bent to cover a portion of the components, thus retaining the components within the housing.

The aforementioned may be achieved in an aspect of the present inventive concept by providing a shaving head. The shaving head may include a housing, at least one retainer extending from the housing, and at least one component retained within the housing by the at least one retainer. The at least one retainer may include a body. The body of the at least one retainer may be bent such that at least a portion of the at least one component is covered by a portion of the at least one retainer. The at least one component may include at least one blade, a guard bar, a cap, at least one lubrication strip, or a combination thereof. The housing may extend along a longitudinal axis. The housing may have a top side, a bottom side opposite to the top side, first and second longitudinal walls, and first and second side walls. The first and second longitudinal walls each may extend longitudinally along the longitudinal axis between the top and bottom sides. The first and second side walls may each extend between the first and second longitudinal walls. The housing may be provided with at least one through hole extending transversally to the longitudinal axis through the housing between the top side and the bottom side. The at least one retainer may be inserted in and extend from the corresponding at least one through hole in at least one of the first and second side walls. The number of through holes may be two, in which one of the two through holes may be provided in each of the first and second side walls. The number of retainers may also be two, in which the retainers may correspond with the two through holes. The housing may include at least one stop on a bottom of the housing, proximate the at least one through hole. The at least one retainer may include at least one ear with a positioning surface extending from the body. The positioning surface of the at least one ear may correspond to the at least one stop of the housing. The positioning surface of the at least one ear may abut the at least one stop of the housing. The at least one sheet retainer may include two ears extending from the body such that the at least one retainer has an inverse T-shape. The at least one retainer may be inserted in the corresponding at least one through from a bottom of the housing. A thickness of the at least one retainer may be between about 0.5 mm and about 1.2 mm. A thickness of the at least one retainer may be about 0.5 mm. The at least one retainer, when bent, may be lower than or even with the top side of the housing. The at least one retainer, when bent, may be lower than the top side of the housing by a distance between about 0.0 mm and about 0.9 mm. The at least one retainer, when bent, may be lower than the top side of the housing by a distance of about 0.5 mm. The at least one retainer, when bent, may cover a portion of lateral sides of the at least one component. The at least one retainer may be made of a metal.

The aforementioned may be achieved in another aspect of the present inventive concept by providing a shaving razor. The shaving razor may include a handle and a shaving head coupled with the handle. The shaving head may include a housing, at least one retainer extending from the housing, and at least one component retained within the housing by the at least one retainer. The at least one retainer may include a body. The body of the at least one retainer may be bent such that at least a portion of the at least one component is covered by a portion of the at least one retainer.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there are shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present inventive concept and, together with the description, serve to explain advantages and principles consistent with the present inventive concept.

DETAILED DESCRIPTION

Figure 1:
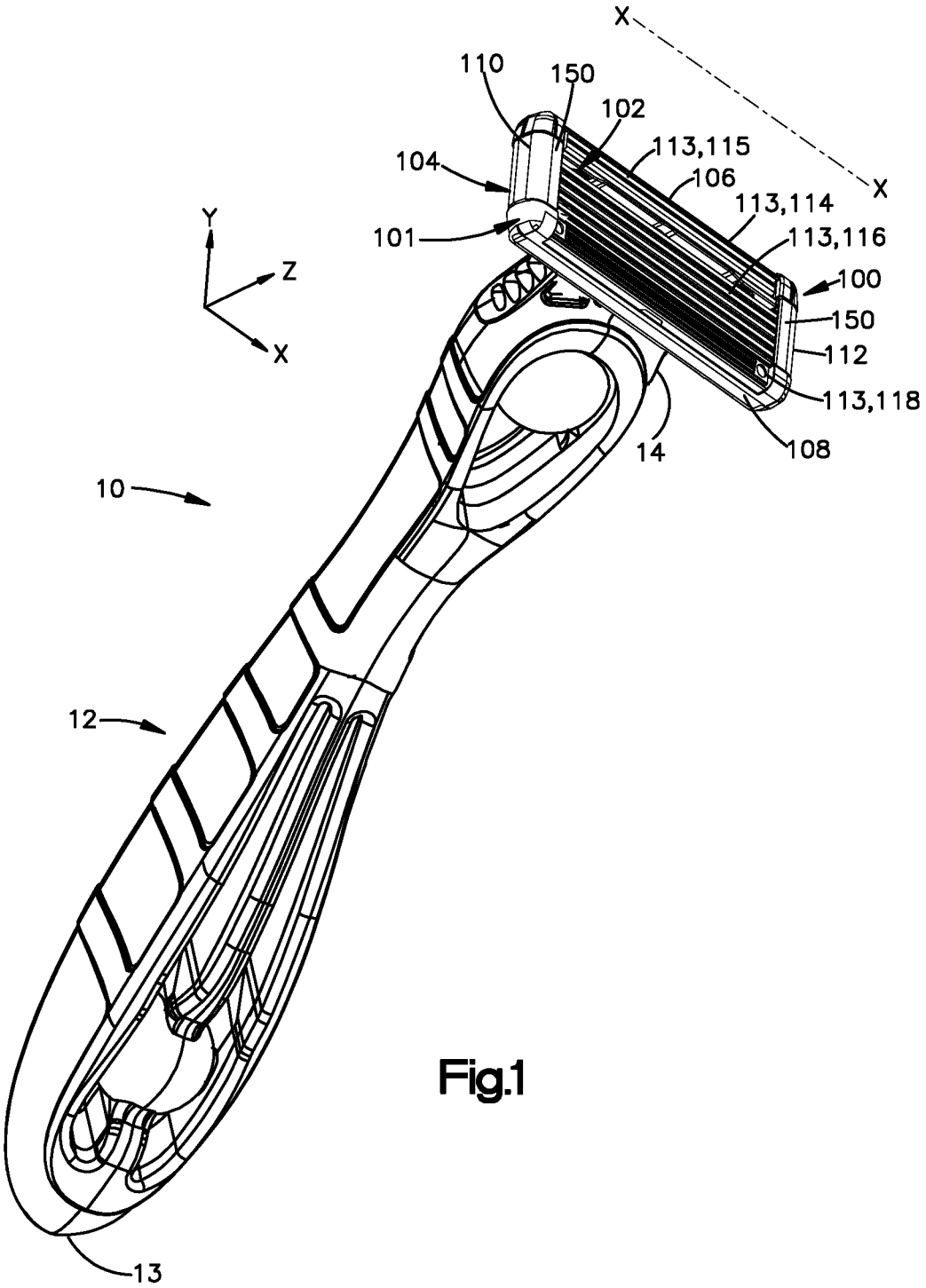
FIG. 1 is a diagram illustrating a perspective view of a shaving razor with a handle and a shaving head.

It is to be understood that the present inventive concept is not limited in its application to the details of construction and to the embodiments of the components set forth in the following description or illustrated in the drawings. The figures and written description are provided to teach any person skilled in the art to make and use the inventions for which patent protection is sought. The present inventive concept is capable of other embodiments and of being practiced and carried out in various ways. Persons of skill in the art will appreciate that the development of an actual commercial embodiment incorporating aspects of the present inventive concept will require numerous implementations—specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be, or become, apparent to one with skill in the art upon examination of the figures and the detailed description. It is intended that all such additional systems, methods, features, and advantages be included within this description, be within the scope of the present inventive concept, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be, or become, apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

FIG. 1 illustrates a shaving razor 10 which includes a handle 12 coupled with a shaving head 100. The handle 12 extends in a handle direction between a proximal end 13 and a distal end 14. The shaving head 100 is coupled with the distal end 14 of the handle 12. In at least one example, the shaving head 100 may be removably coupled with the handle 12, for example, by a lock and release mechanism. In other examples, the shaving head 100 may be fixedly coupled with the handle 12 such that the shaving head 100 is not configured to be removably coupled with or selectively separated from the handle 12. The handle 12 may be operable to pivot relative to the shaving head 100. In other examples, the handle 12 may be secured to the shaving head 100 in a fixed relationship such that the shaving head 100 is not operable to pivot relative to the handle 12. The handle 12 may be any suitable shape to allow a user to securely grip the handle 12. It is foreseen that the handle 12 may include one continuous curve or include one straight portion or several curved and/or straight portions extending along an entirety of or a substantial portion of the handle 12 without deviating from the scope of the present inventive concept.

The shaving head 100 includes a housing 101. The housing 101 extends along a longitudinal axis X-X. The housing 101, as illustrated, has a substantially rectangular shape, but may be any suitable shape such as ovoid or circular without deviating from the scope of the present inventive concept. The shaving head 100 and the housing 101 include a top side 102 and a bottom side 104 opposite the top side 102. The bottom side 104 is proximate to the handle 12, and the top side 102 includes at least one skin contacting area. The housing 101 includes first and second longitudinal walls 106, 108. Each of the first and second longitudinal walls 106, 108 extends longitudinally along the longitudinal axis X-X between the top and bottom sides 102, 104 and in a direction Z of the housing 101. The first and second longitudinal walls 106, 108, as illustrated, extend substantially parallel to each other. First and second side walls 110, 112 extend substantially parallel to each other and between the first and second longitudinal walls 106, 108 along a direction Y of the housing 101. The first and second side walls 110, 112 also extend between the top and bottom sides 102, 104 along the direction Z of the housing 101. The housing 101 may be made of plastic, metal, another suitable material, or any combination thereof without deviating from the scope of the present inventive concept.

The shaving head 100 includes a plurality of components 113 which assist and contribute to the shaving experience of the user. One of the components 113 is a plurality of blades 116 disposed and retained within the housing 101. The blades 116 extend along the longitudinal axis X-X. In at least one example, the shaving head 100 can include one, two, three, four, or more of the blades 116 without deviating from the scope of the present inventive concept. The blades 116 may be movably disposed or freely mounted, in the housing 101. For example, the blades 116 may be coupled with elastic fingers which extend from the housing 101. In other examples, the blades 116 may be fixedly disposed in the housing 101.

The components 113 of the shaving head 100 also include a cap 114, a lubricating strip 115, and a guard bar 118 included on and/or retained within the shaving head 100. The cap 114 is coupled with the first longitudinal wall 106. The lubricating strip 115 is disposed on the top side 102 of the cap 114 to deliver a friction reduction effect, an anti-irritation effect, and/or provide lubrication after shaving. The guard bar 118 is coupled with the second longitudinal wall 108 opposite the cap 114 to stretch the skin during shaving or dispense the forces applied to the skin, thereby causing the shaving head 100 to glide across the skin while providing a closer shave. The cap 114, the lubricating strip 115, and the guard bar 118 each extend along the longitudinal axis X-X. Additional components, e.g., a cover and/or one or more trimming blades, may also be included on and retained within the shaving head 100 without deviating from the scope of the present inventive concept.

The components 113 are retained within or on the shaving head 100 by retainers 150. For example, the retainers 150 are operable to retain the blades 116, the cap 114, the lubricating strip 115, and the guard bar 118 on or within the shaving head 100. As illustrated, the retainers 150 retain the components 113 by securely abutting and partially covering (i) a portion of the components, e.g., lateral sides or sides along the direction X of the components 113, and (ii) the side walls 110, 112. It is foreseen that the retainers 150 may be operable to secure one or more other components within or on the shaving head 100 without deviating from the scope of the present inventive concept. It is also foreseen that any one or more of the components 113 may be secured to the shaving head 100 without the retainers 150, e.g., via other means, without deviating from the scope of the present inventive concept.

Figure 2A:
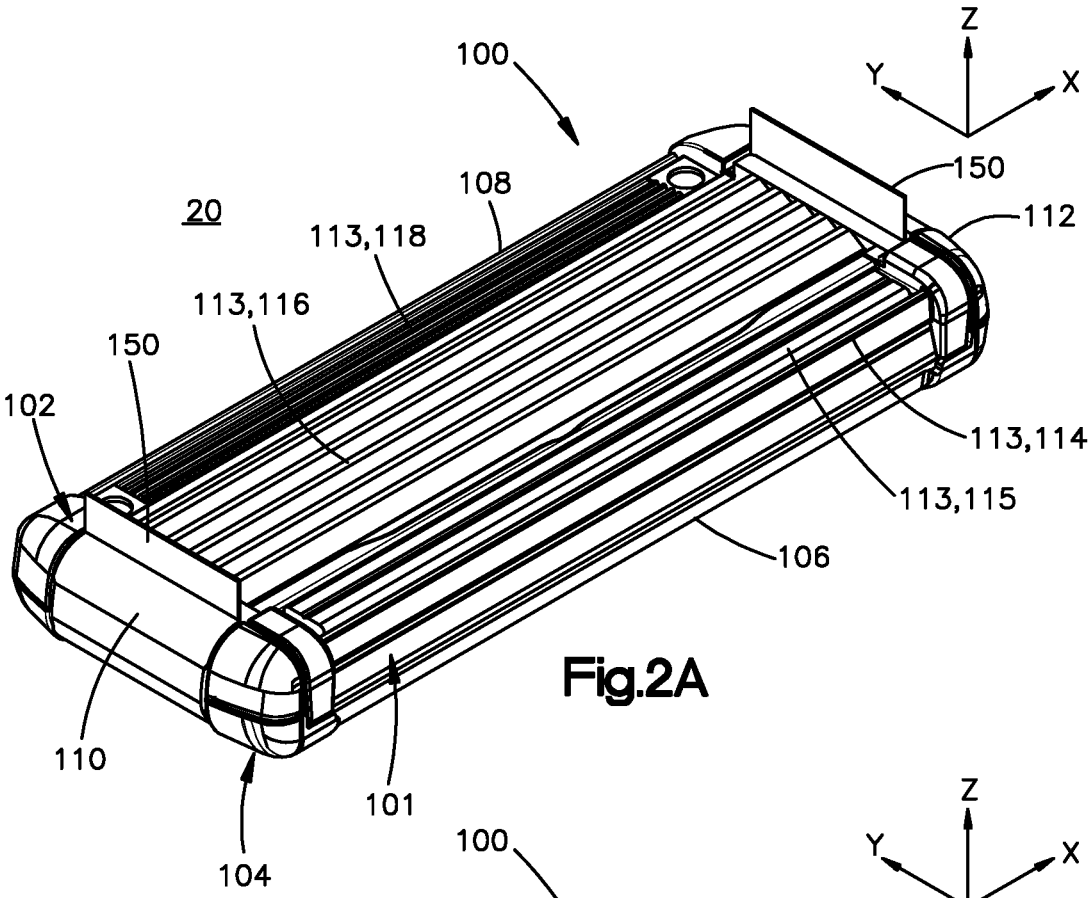
FIG. 2A is a diagram illustrating a perspective view of a shaving head in a first configuration.
Figure 2B:
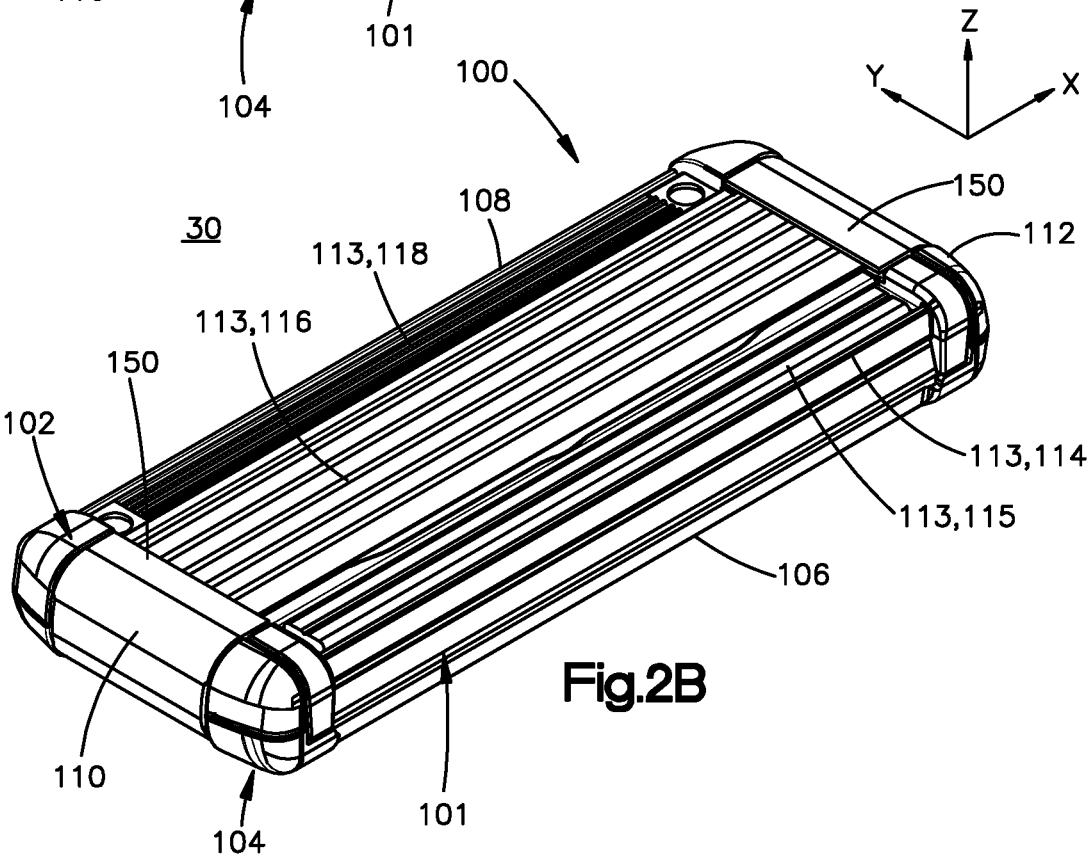
FIG. 2B is a diagram illustrating a perspective view of the shaving head of FIG. 2A in a second configuration.

The retainers 150 extend from the housing 101 in an installed configuration 20. As shown in FIG. 2A, the retainers 150 are sheet retainers which extend from the top side 102 of the first and second side walls 110, 112 in a direction Z. The retainers 150 extend from the housing 101 a distance such that when the retainers 150 are bent into a bent configuration 30, as shown in FIG. 2B, the retainers 150 securely abut and partially cover a portion of the blades 116. Thus, the blades 116 are retained within the housing 101 by the retainers 150. The retainers 150 are bent along a direction X toward the middle or inside of the housing 101. In the illustrated examples, the retainers 150 are bent about 90 degrees. In other examples, the retainers 150 may be bent any suitable angle such that the components 113 are partially covered and secured or retained. It is also foreseeable that the angle the retainer 150 is bent can be varied to adjust the exposure of the blades 116 without deviating from the scope of the present inventive concept. As such, if the retainer 150 is bent at less than 90 degrees, the exposure of the blades 116 can be adjusted. For example, if the exposure of the blades 116 is about 150 μm when the retainer 150 is bent about 90 degrees, a 70 degree bend of the retainer 150 would allow the blades 116 to rest higher, or closer to the skin, thus increasing the exposure. With the retainer 150, the exposure of the blade edges can be accurately managed without changing parts with mold modifications. With the traditional clip design, this is not possible because the bends and lock positions under the housing are dictated by the plastic features. The retainer 150 provides adjustment flexibility to the blade edge exposure. Also, to facilitate bending characteristics related to common sheet metal practices, the precise bend location of the retainer 150 can have a pre-score or weakened section prior to being inserted into the housing 101. While the figures illustrate that the blades 116 are retained by the retainers 150, as discussed above, it is foreseen that the retainers 150 may secure one or more other components 113 within or on the shaving head 100. The retainers 150 are made of metal. In other examples, the retainers 150 may be made of plastic or any other suitable material such that the retainers 150 can be bent while maintaining the structural integrity to securely retain the components 113 in the housing 101. As such, the retainers 150 provide a more secure attachment between one or more components 113 of the shaving head 100 and the housing 101. Also, the retainers 150 provide a more aesthetic appearance for the shaving head 100.

Figure 2C:
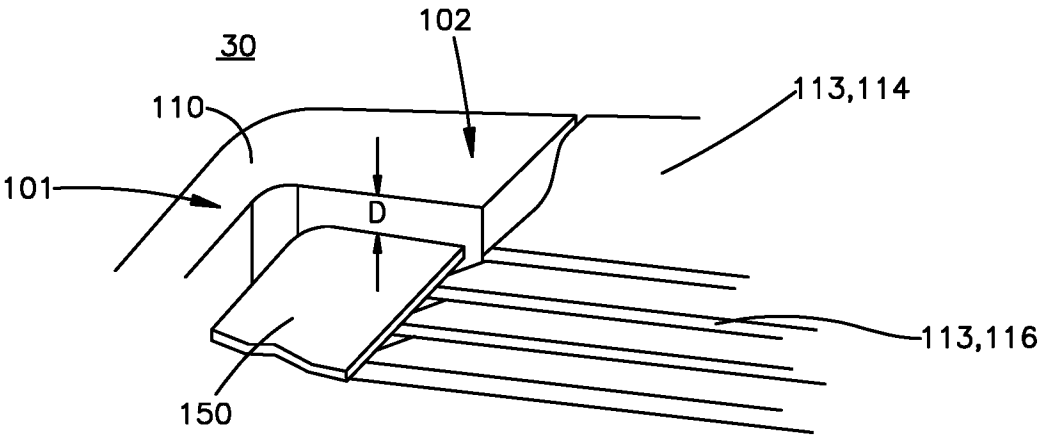
FIG. 2C is a diagram illustrating a partial, perspective view of the shaving head of FIG. 2B.

As shown in FIG. 2C, the retainers 150, when in the bent configuration 30, do not extend above the top side 102 of the housing 101. The bent retainers 150 are kept below the top side 102 of the housing 101 to avoid user interaction with the retainers 150. The top side of the bent retainers 150 maintains a distance D from the top side 102 of the housing 101. The distance D is about 0.5 mm. In other examples, the distance D is inclusive of, about, and/or between 0.0 mm and 0.9 mm.

Figure 4:
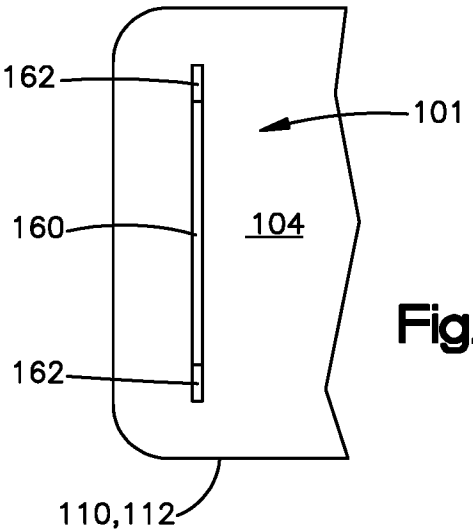
FIG. 4 is a diagram illustrating a bottom plan view of a shaving head.
Figure 3:
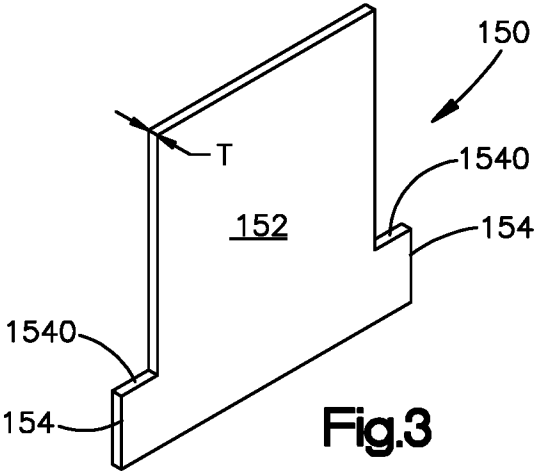
FIG. 3 is a diagram illustrating a perspective view of a retainer.
Figure 5:
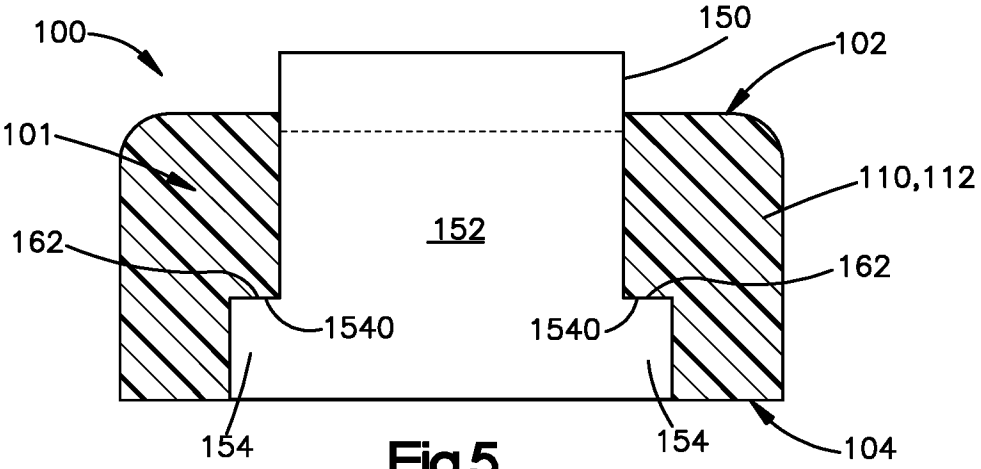
FIG. 5 is a diagram illustrating a cross-sectional view of a shaving head with one embodiment of a retainer inserted therein.

FIGS. 3-5 illustrate one embodiment of a retainer 150. As illustrated in FIG. 3, the retainer 150 includes a body 152 and two ears 154 which extend from the body 152 such that the retainer has an inverse T shape. It is foreseen that the retainer 150 could be designed so that the body 152 has more or less ears 154 extending therefrom without deviating from the scope of the present inventive concept. It is also foreseen that the two bottom inserted retainers 150 may be a one-piece part, instead of two, and be connected by a portion which is provided along the bottom side 104 of the housing 101 without deviating from the scope of the present inventive concept. The retainer 150 has a thickness T of about 0.5 mm. In other examples, the retainer 150 has a thickness T inclusive of, about, and/or between 0.5 mm and 1.2 mm to minimize bulkiness of the shaving head 100 and to keep the bending stresses low. As illustrated, the retainer 150 has a substantially uniform thickness. It is foreseen that the retainer 150 could be designed to have varying thicknesses throughout the retainer 150 without deviating from the scope of the present inventive concept. The dimensions and proportions of the retainer 150 may vary as desired, so long as the retainer 150 can be inserted into the housing 101 and bent to cover and secure at least a portion of the components 113.

The housing 101, as shown in FIG. 4, includes through holes 160 which correspond to and receive the retainers 150. The through holes 160 extend transversally to the longitudinal axis X-X and in the direction Z through the housing 101 between the top and bottom sides 102, 104. The through holes 160 may be provided in the first and second side walls 110, 112 of the housing 101. It is foreseen that the more or less through holes 160 may be provided in the housing 101 in different areas as desired without deviating from the scope of the present inventive concept. The housing 101 also includes one or more stops 162 proximate to the through holes 160. The number and shape of the stops 162 correspond with the number and shape of the ears 154 of the retainers 150. The stops 162 receive and abut the ears 154 of the retainers 150. As such, the ears 154 assist in positioning and securing the retainer 150 in the housing 101. The ears 154, as illustrated in FIG. 3, include positioning surfaces 1540. The positioning surfaces 1540 are on the top of the ears 154. The positioning surfaces 1540 may be flat, curved, or any desired shape such that the positioning surfaces 1540 correspond to the stops 162 in the housing 101. As the retainers 150 are inserted through the housing 101 from the bottom side, the positioning surfaces 1540 of the ears 154 abut the corresponding stops 162. The abutment between the positioning surfaces 1540 and the stops 162 prevent the retainers 150 from moving further in the Z direction. As such, the retainers 150 are easily positioned and locked into position by the interaction between the positioning surfaces 1540 of the ears 154 and the stops 162.

As illustrated in FIG. 5, the retainer 150 can be inserted into the corresponding through hole 160 (for example, as shown in FIG. 4) from the bottom side 104 of the housing 101. The body 152 is inserted into the through hole 160 until the ears 154 abut the stops 162 of the housing 101. The retainer 150 then cannot extend further, and a portion of the retainer 150 extends from the top side 102 of the housing 101. The broken line illustrates the line in which the retainer 150 can be bent.

Figure 6:
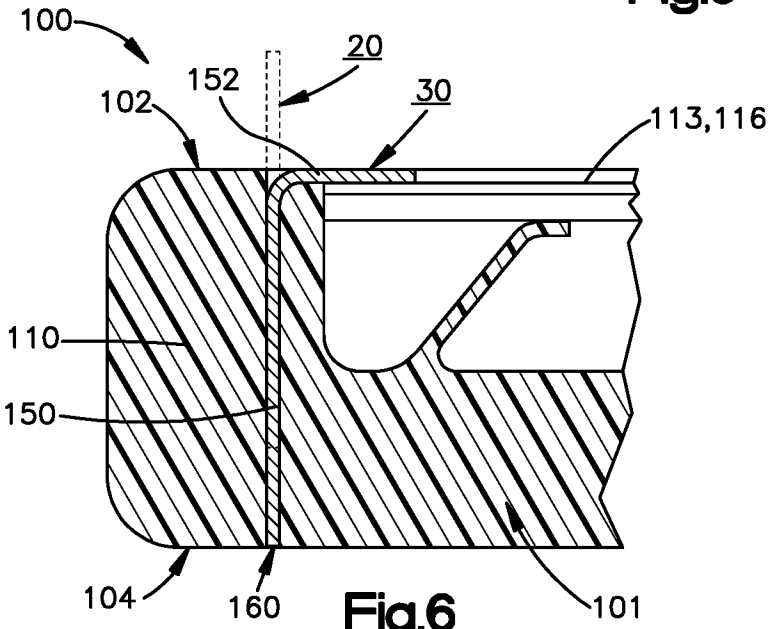
FIG. 6 is a diagram illustrating a cross-sectional view of a shaving head of FIG. 5.

The retainer 150 is bent from the installed configuration 20 to the bent configuration 30, as illustrated in FIG. 6. The dotted line illustrates the installed configuration 20 before the retainer 150 is bent. As shown in FIG. 6, the bent retainer 150 covers at least a portion of the blades 116, thus securing and retaining the blades 116 in the housing 101. It is foreseen that a bottom cover may be provided along the bottom side 104 of the housing 104 to further secure the retainer 150 in the housing 101 without deviating from the scope of the present inventive concept. As shown in FIGS. 5 and 6, the bottom side 104 of the housing 101 may include a flush bottom surface. It is foreseen that the bottom side 104 of the housing 101 may not be flush without deviating from the scope of the present inventive concept.

Figure 7:
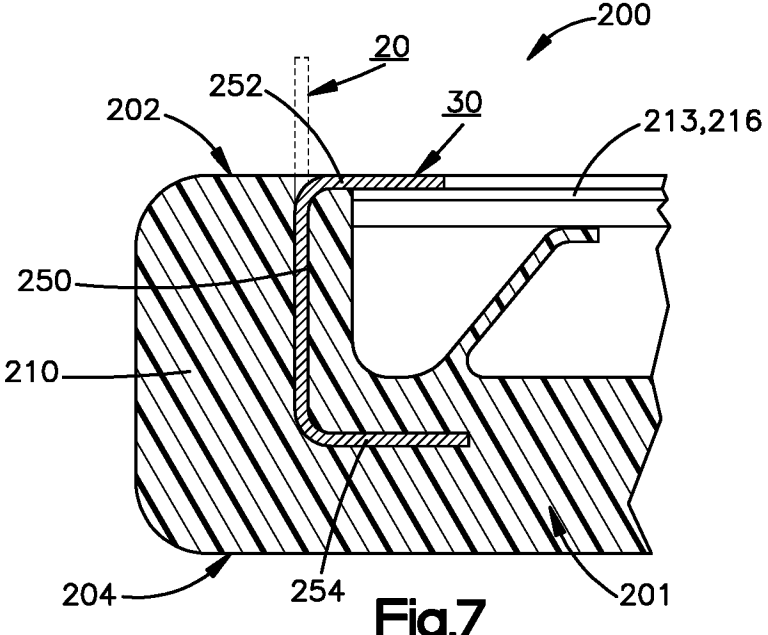
FIG. 7 is a diagram illustrating a cross-sectional view of a shaving head with another embodiment of a retainer inserted therein.

Turning to FIG. 7, another embodiment of the present inventive concept is illustrated with a shaving head 200. Similar to the embodiment illustrated in FIGS. 1-6, the shaving head 200 includes a plurality of components 213 which assist and contribute to the shaving experience of the user. One of the components 213 is a plurality of blades 216 disposed and retained within the housing 201. The blades 216 extend along the longitudinal axis X-X. In at least one example, the shaving head 200 can include one, two, three, four, or more of the blades 216 without deviating from the scope of the present inventive concept. The blades 216 may be movably disposed or freely mounted, in the housing 201. For example, the blades 216 may be coupled with elastic fingers which extend from the housing 201. In other examples, the blades 216 may be fixedly disposed in the housing 201.

The components 213 of the shaving head 200 also include a cap, a lubricating strip, and a guard bar included on and/or retained within the shaving head 200. Additional components, e.g., a cover and/or one or more trimming blades, may also be included on and retained within the shaving head 200 without deviating from the scope of the present inventive concept.

A plurality of the components 213 is retained within the shaving head 200 by retainers 250. For example, the retainers 250 are operable to retain the blades 216, the cap, the lubricating strip, and the guard bar within the shaving head 200. The retainers 250 may be installed in each of the two side walls of the housing 201. It is foreseen that the retainers 250 may be installed in other walls or only one of the side walls of the housing 201 as desired without deviating from the scope of the present inventive concept. As illustrated, the retainers 250 retain the components 213 by securely abutting and partially covering (i) a portion of the components 213, e.g., lateral sides or sides along the direction X of the components 213, and (ii) the side walls. It is foreseen that the retainers 250 may be operable to secure one or more other components 213 within or on the shaving head 200 without deviating from the scope of the present inventive concept. It is also foreseen that any one or more of the components 213 may be secured to the shaving head 200 without the retainers 250, e.g., via other means, without deviating from the scope of the present inventive concept.

The retainers 250 extend from the housing 201 in an installed configuration 20, as shown by the dotted lines. The retainers 250 are sheet retainers which extend from the top side 202 of the first and second side walls in a direction Z. The retainers 250 extend from the housing 201 a distance such that when the retainers 250 are bent into a bent configuration 30, the retainers 250 securely abut and partially cover a portion of the blades 216. Thus, the blades 216 are retained within the housing 201 by the retainers 250. The retainers 250 are bent along a direction X toward the middle or inside of the housing 201. In the illustrated examples, the retainers 250 are bent about 90 degrees. In other examples, the retainers 250 may be bent any suitable angle such that the components 213 are partially covered and secured or retained. It is also foreseeable that the angle the retainer 250 is bent can be varied to adjust the exposure of the blades 216 without deviating from the scope of the present inventive concept. As such, if the retainer 250 is bent at less than 90 degrees, the exposure of the blades 216 can be adjusted. For example, if the exposure of the blades 216 is about 150 μm when the retainer 250 is bent about 90 degrees, a 70 degree bend of the retainer 250 would allow the blades 216 to rest higher, or closer to the skin, thus increasing the exposure. With the retainer 250, the exposure of the blade edges can be accurately managed without changing parts with mold modifications. With the traditional clip design, this is not possible because the bends and lock positions under the housing are dictated by the plastic features. The retainer 250 provides adjustment flexibility to the blade edge exposure. Also, to facilitate bending characteristics related to common sheet metal practices, the precise bend location of the retainer 250 can have a pre-score or weakened section prior to being inserted into the housing 201. While the figures illustrate that the blades 216 are retained by the retainers 250, as discussed above, it is foreseen that the retainers 250 may secure one or more other components 213 within or on the shaving head 200. The retainers 250 are made of metal. In other examples, the retainers 250 may be made of plastic or any other suitable material such that the retainers 250 can be bent while maintaining the structural integrity to securely retain the components 213 in the housing 201. As such, the retainers 250 provide a more secure attachment between one or more components 213 of the shaving head 200 and the housing 201. Also, the retainers 250 provide a more aesthetic appearance for the shaving head 200.

Similar to the retainer illustrated in FIG. 2C, the retainers 250, when in the bent configuration 30, do not extend above the top side 202 of the housing 201. The bent retainers 250 are kept below the top side 202 of the housing 201 to avoid user interaction with the retainers 250. The top side of the bent retainers 250 maintains a distance from the top side 202 of the housing 201 of about 0.5 mm. In other examples, the distance is inclusive of, about, and/or between 0.3 mm and 0.9 mm.

The retainer 250, as illustrated in FIG. 7, includes a body 252 and an ear 254 which is a bent surface from the body 252, forming substantially an L shape. It is foreseen that the retainer 250 could be designed so that the body 252 has more or less ears 254 extending therefrom without deviating from the scope of the present inventive concept. Similar to the retainer in FIGS. 1-6, the retainer 250 has a thickness of about 0.5 mm. In other examples, the retainer 250 has a thickness inclusive of, about, and/or between 0.5 mm and 1.2 mm to minimize bulkiness of the shaving head 200 and to keep the bending stresses low. As illustrated, the retainer 250 has a substantially uniform thickness. It is foreseen that the retainer 250 could be designed to have varying thicknesses throughout the retainer 250 without deviating from the scope of the present inventive concept.

To manufacture the shaving head 200 with the retainer 250, the retainer 250 is placed/inserted into an injection mold. Material for the housing 201, for example plastic, polymer, or any other suitable material, is injected into the mold. Production of the housing 201 progresses with the retainer 250 integrated therewith. The retainer 250 is secured within the housing 201 due to the ear 254, and extends from the top side 202 of the housing 201 in the installed configuration 20. After production of the housing 201, blades 216 and other components 213 are placed in the shaving head 200. The retainer 250 is deformed and bent to a bent configuration 30 by pressure, force, or any suitable method, to cover a portion of the desired components 213, thus securing and retaining the desired components 213.

For the different embodiments, the retainers, for example retainers 150, 250, can be manufactured by a sheet metal process and prepared prior to assembly of the shaving head 100. Truss design features may be included to strengthen the retainers 150, 250. For example, an I-beam design may be utilized to minimize bending in undesired directions.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A shaving head comprising:

a housing extending along a longitudinal axis, the housing having:

a top side, a bottom side opposite to the top side, first and second longitudinal walls, the first and second longitudinal walls each extending longitudinally along the longitudinal axis and extending perpendicular to the longitudinal axis between the top and bottom sides, first and second side walls each extending between the first and second longitudinal walls, the housing being provided with at least one through hole in at least one of the first and second side walls, the at least one through hole opening on the top side and extending between the top side and the bottom side to open on the bottom side, wherein the housing includes two stops formed on the bottom of the housing proximate the at least one through hole forming a T-shape, at least one component positioned within the housing; and at least one retainer including a body and two ears extending from the body to form a T-shaped plate, wherein the body of the retainer is inserted into the housing from the opening formed in the bottom of the housing, wherein a first portion of the body of the retainer is disposed within the housing and a second portion of the body extends from a top side of one of the first or second side walls of the housing and is bent to cover at least a portion of the at least one component to retain the at least one component within the housing, wherein the two ears abut against the two stops of the housing.

2. The shaving head of claim 1, wherein the at least one component includes at least one blade, a guard bar, a cap, at least one lubrication strip, or a combination thereof.

3. The shaving head of claim 1, wherein the at least one through hole being two through holes, one of the two through holes provided in each of the first and second side walls.

4. The shaving head of claim 1, wherein the at least one retainer being two retainers, and the at least one through hole being two through holes, the two retainers corresponding with the two through holes.

5. The shaving head of claim 1, wherein the two ears have a positioning surface at a top of the two ears, the positioning surface of the two ears corresponding to the two stops of the housing, and the positioning surface of each of the two ears abuts the corresponding of the two stops of the housing.

6. The shaving head of claim 1, wherein a thickness of the at least one retainer is between about 0.5 mm and about 1.2 mm.

7. The shaving head of claim 1, wherein a thickness of the at least one retainer is about 0.5 mm.

8. The shaving head of claim 1, wherein the second portion of the at least one retainer being bent to be positioned to be even with the top side of the housing or being bent to be positioned below the top side of the housing and above the at least one component.

9. The shaving head of claim 1, wherein the at least one retainer, when bent, is positioned below the top side of the housing by a distance between 0.3 mm and 0.9 mm.

10. The shaving head of claim 1, wherein the at least one retainer, when bent, is positioned below the top side of the housing by a distance of 0.5 mm.

11. The shaving head of claim 1, wherein the at least one retainer, when bent, covers a portion of lateral sides of the at least one component.

* * * * *